US006847158B1

(12) United States Patent
Farizon et al.

(10) Patent No.: US 6,847,158 B1
(45) Date of Patent: Jan. 25, 2005

(54) ELECTRODE STRUCTURE FOR ELECTRON GUN

(75) Inventors: Arnaud Farizon, Dijon (FR); Philippe Arnaud, Fontaine les Dijon (FR)

(73) Assignee: Thomson Licensing S.A., Boulogne-Billancourt (FR)

( * ) Notice: Subject to any disclaimer, the term of this patent is extended or adjusted under 35 U.S.C. 154(b) by 0 days.

(21) Appl. No.: 09/889,110

(22) PCT Filed: Feb. 11, 2000

(86) PCT No.: PCT/EP00/01131

§ 371 (c)(1),
(2), (4) Date: Jul. 11, 2001

(87) PCT Pub. No.: WO00/48221

PCT Pub. Date: Aug. 17, 2000

(30) Foreign Application Priority Data

Feb. 11, 1999 (FR) ..... 99 01628

(51) Int. Cl.[7] ..... H01J 29/46
(52) U.S. Cl. ..... 313/446; 313/447; 313/458
(58) Field of Search ..... 313/414, 417, 313/446, 452, 458, 460; 15/382, 382.1

(56) References Cited

U.S. PATENT DOCUMENTS

| | | | | |
|---|---|---|---|---|
| 2,582,454 A | * | 1/1952 | Pohle | 313/250 |
| 2,842,702 A | | 7/1958 | Titcomb et al. | 315/1 |
| 5,574,330 A | * | 11/1996 | Matsuda et al. | 313/412 |
| 5,861,708 A | * | 1/1999 | Van Eck | 313/414 |

FOREIGN PATENT DOCUMENTS

| | | | |
|---|---|---|---|
| EP | 415562 | 3/1991 | H01J/29/48 |
| FR | 834.085 | 11/1938 | |

* cited by examiner

*Primary Examiner*—Joseph Williams
*Assistant Examiner*—Peter Macchiarolo
(74) *Attorney, Agent, or Firm*—Joseph S. Tripoli; Harvey D. Fried; Patricia A. Verlangieri

(57) ABSTRACT

An electron gun for a cathode-ray tube comprises a dish-shaped control electrode. The electrode is made from three separate components: a substantially plane component drilled with apertures so as to allow the passage of electron beams, and two identically shaped components intended to make a skirt, serving as support for the cathode modules. The three components are welded together. This structure allows the construction of a control electrode serving as support for cathode modules by virtue of inexpensive components that are simple to manufacture.

3 Claims, 3 Drawing Sheets

FIG.1
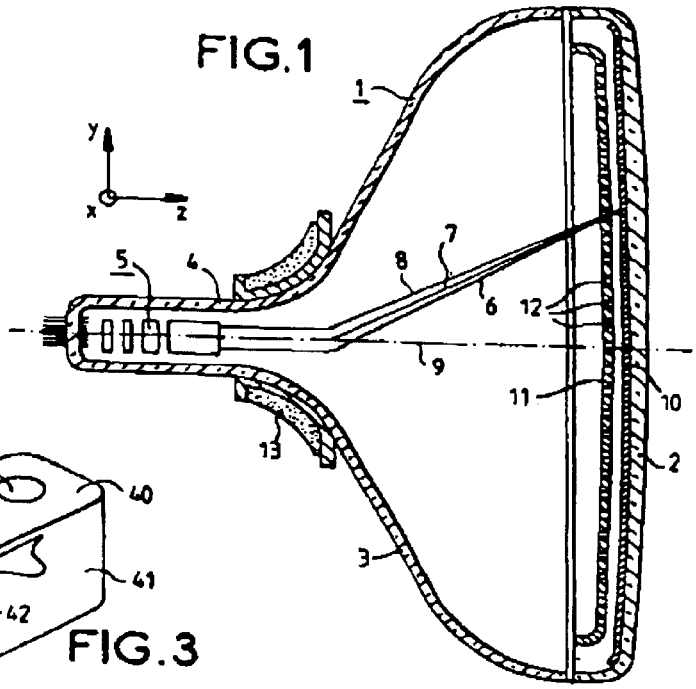
PRIOR ART
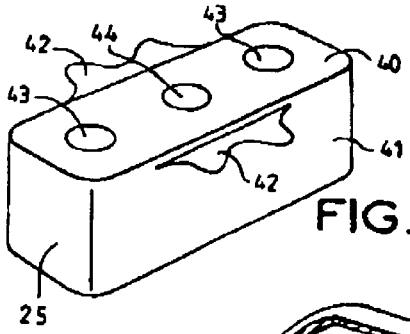
FIG.3
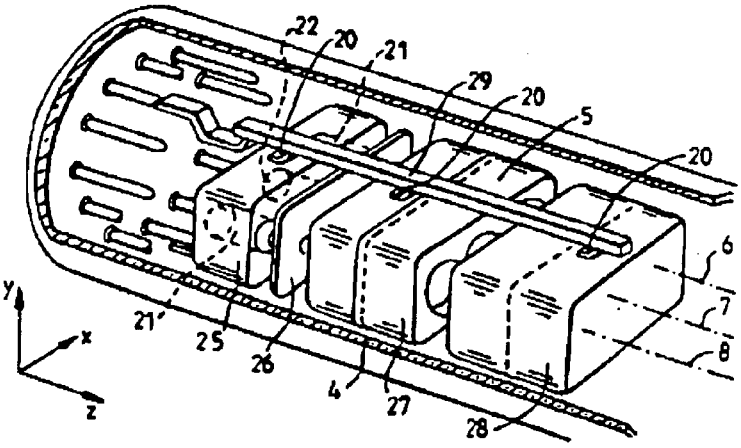
PRIOR ART
FIG.2

ELECTRODE STRUCTURE FOR ELECTRON GUN

CROSS-REFERENCE TO RELATED APPLICATIONS

This application claims the benefit of French patent application serial no. 9901628 filed Feb. 11, 1999, which is hereby incorporated herein by reference, and which claims the benefit under 35 U.S.C. § 365 of International Application PCT/EP00/01131, filed Feb. 11, 2000, which was published in accordance with PCT Article 21(2) on Aug. 17, 2000 in English.

FIELD OF THE INVENTION

The invention relates to an electron gun for a cathode-ray tube and more particularly to the manner of making certain electrodes which extend along the path of the electron beams in the direction of the screen of the tube.

BACKGROUND OF THE INVENTION

In an electron gun for cathode-ray tubes, a few components are of elongate shape in the direction of the beam or beams generated by one or more cathodes. The objective of these elongate shapes is to form said beams or to make them converge towards the screen of the tube. The first electrode of the gun, also referred to as the control electrode, may also be of elongate shape and surround the cathode or cathodes more or less totally. In this case, the elongate shape allows confinement of the energy dissipated by the cathode filaments, so as to render the latter emissive and thereby increase the energy yield of the assembly.

The control electrode G1, drilled with one or more orifices for the passage of the electron beams, may be made by deep-drawing, in such a way as to make the electrode surface and its lateral skirt from one planar component. Such an electrode G1, is for example illustrated by the Dutch patent application 8103395. It is also possible to make the electrode G1 by welding, onto the plane part drilled with orifices, a lateral skirt obtained by bending. These methods have shown their limitations since the subsequent adjusting of the cathode modules can only be done readily if the shape and final dimensions of the electrode G1 are perfectly controlled and in accordance with those specified. The methods of the prior art do not enable the shape of the electrode G1 to be controlled with sufficient accuracy.

SUMMARY OF THE INVENTION

The electron gun according to the invention affords a solution to this problem. It comprises at least one cathode for emitting an electron beam, a dish-shaped control electrode G1, comprising a substantially planar part provided with at least one aperture for the passage of the electron beam emanating from the cathode and a skirt at least partially surrounding the cathode, means for supporting the cathode so as to keep the latter at a specified distance from the electrode G1, characterized in that the control electrode G1 comprises at least three separate metal components:

- a substantially planar component drilled with apertures which are intended to face each cathode,
- at least two metal components forming the lateral skirt at least partially surrounding the cathode, the two components being secured to one another as well as to the planar part, for example by welding.

Moreover, the invention has the advantage of allowing the modification of any electron gun comprising a planar control electrode G1, by the addition of a structure made from two components so as to form a lateral skirt for confinements, which did not exist in the starting electrode G1, without modifying the shape of the initial electrode.

BRIEF DESCRIPTION OF THE DRAWING

The invention will be better understood with the aid of the description and of the drawings below in which;

FIG. 1 is a cathode-ray tube according to the invention:

FIG. 2 shows an exploded view of the rear part of a tube incorporating a gun according to the prior art;

FIG. 3 illustrates a mode of making a dish-shaped electrode G1 by deep-drawing according to the prior art;

DETAILED DESCRIPTION

Figure 4:
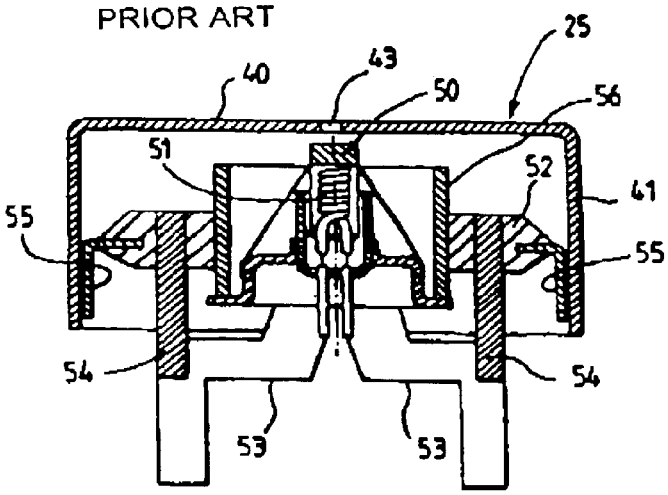
FIG. 4 is a section through the bottom part of the electron gun according to the prior art.

As illustrated by FIG. 1, a color cathode-ray tube 1 comprises a front face 2 onto which are deposited networks of luminescent materials 10 intended for reproducing a coloured image under the impact of electron beams 6, 7, 8 generated by an electron gun 5. A color selection mask 11, drilled with holes 12, is interposed between the gun 5 and the front face so that each electron beam illuminates only the parts corresponding thereto on the screen. A system 13 for deflecting the electron beams is arranged on the neck 4 of the tube so that the beams 6, 7, 8 sweep the whole of the screen 10.

FIG. 2 shows an electron gun according to the prior art in greater detail. This gun 5 comprises three cathodes, a central cathode 22 and two lateral cathodes 21, a dish-shaped electrode G1 25, and a succession of electrodes 26, 27, 28 etc. The electrodes are drilled with holes to allow the passage of the electron beams 6, 7, 8. The electrodes are secured to one another by virtue of glass beads 29 into which are inserted metal parts 20 of said electrodes, FIG. 3 illustrates a mode of making an electrode G1 by deep drawing according to the prior art. The electrode 25 consists of a planar face 40 drilled with holes 44, 43 for the passage of the electron beams and of a lateral skirt 41 substantially perpendicular to the planar face 40. Metal parts 42 project from the electrode 25 for insertion into the beads 29.

FIG. 4 shows a section through the cathode/G1 assembly of FIG. 3, in a plane parallel to the longitudinal axis Z of the tube, level with a lateral orifice 43 of G1.

The cathode 50 possesses means of support 55, 56 inside G1, which are insulated from G1 by parts 52 made for example of ceramic. A filament 51 for heating the cathode is supplied electrically with the aid of conductors 53 linked to rigid terminals 54. The means of support 55 are welded to the skirt 41 of the electrode so as to secure the cathode to G1. The cathode or cathodes must be secured to the electrode G1 in such a way that the position of each cathode and its distance from the hole in G1 corresponding thereto is very accurately fixed. If the shapes and dimensions of the electrode G1 do not correspond accurately to the nominal shapes and dimensions, it will not be possible for the welding of the cathode modules inside the dish to be performed accurately;

this will for example result in the surface of the cathode 50 not being arranged perfectly facing the aperture 433 and in the surface 40 bearing the apertures 43, 44 being deformed by the mechanical stress exerted by the welding of the supports 55 because the dimensions do not correspond perfectly. These problems may be engendered by the difficulty of making the component G1 by deep-drawing, a method which. In mass production, does not allow the geometrical dimensions to be controlled with sufficient accuracy.

It is known moreover to make a dish-shaped G1 by welding a lateral skirt 41 onto a planar electrode surface 40. The surface of G1 containing the orifices 43, 44 is a surface whose geometry is highly critical since it acts directly in the zone of formation of the electron beam or beams. The end part of the skirt should have a geometry which is defined perfectly so as to fit the surface of the planar part 40 to which it is intended to be welded, otherwise it will give rise to mechanical stresses which will modify the nominal shapes and dimensions of G1. This is what generally occurs when the skirt 41 is an annular flange.

The invention proposes a structure for making an electrode skirt allowing said skirt to be fined without mechanical stress to any type of substantially planar electrode.

Figure 5:
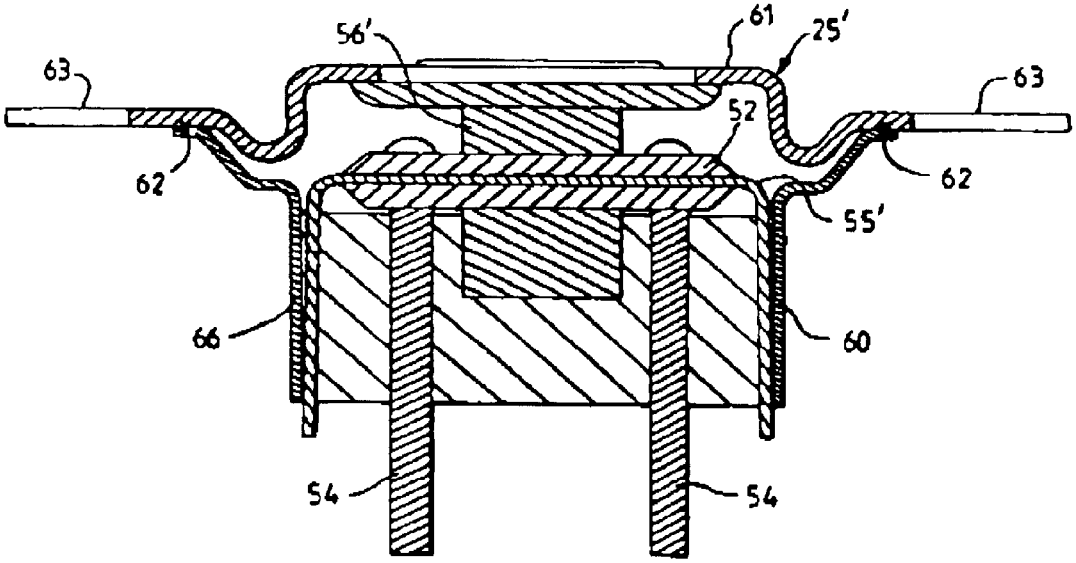
FIG. 5 is an exploded view of an embodiment of the invention including the electrode G1 and the cathode supports.

FIG. 5 shows an exploded view of an electrode G1 and cathode supports according to the invention. The electrode 25' possesses a substantially planar part 61 drilled with apertures to allow the passage of the electron beams emanating from the cathodes. The ends 63 are intended to be inserted into glass beads ensuring the rigidity of the gun and the relative positioning of its constituent electrodes. The cathode supports comprise a first skirt 56' surrounding the cathode and its filament, tabs 55' insulated from the skirt by a ceramic annulus 52, and rigid terminals 54 for receiving the filament supply wires. Two components 60, 66 secured to one another, for example by welding, form a skirt which surrounds the cathode supports; the skirt 60, 66 may either surround a single cathode module or the assembly of three modules in the case of inline guns for a color cathode-ray tube; the cathode supports and the skirt 60, 66 are secured for example by welding the tabs 55 to said skirt 60, 66, the assembly is then secured to the electrode G1 by welding the periphery 62 of the skirt 60, 66 to said electrode.

Figure 6:
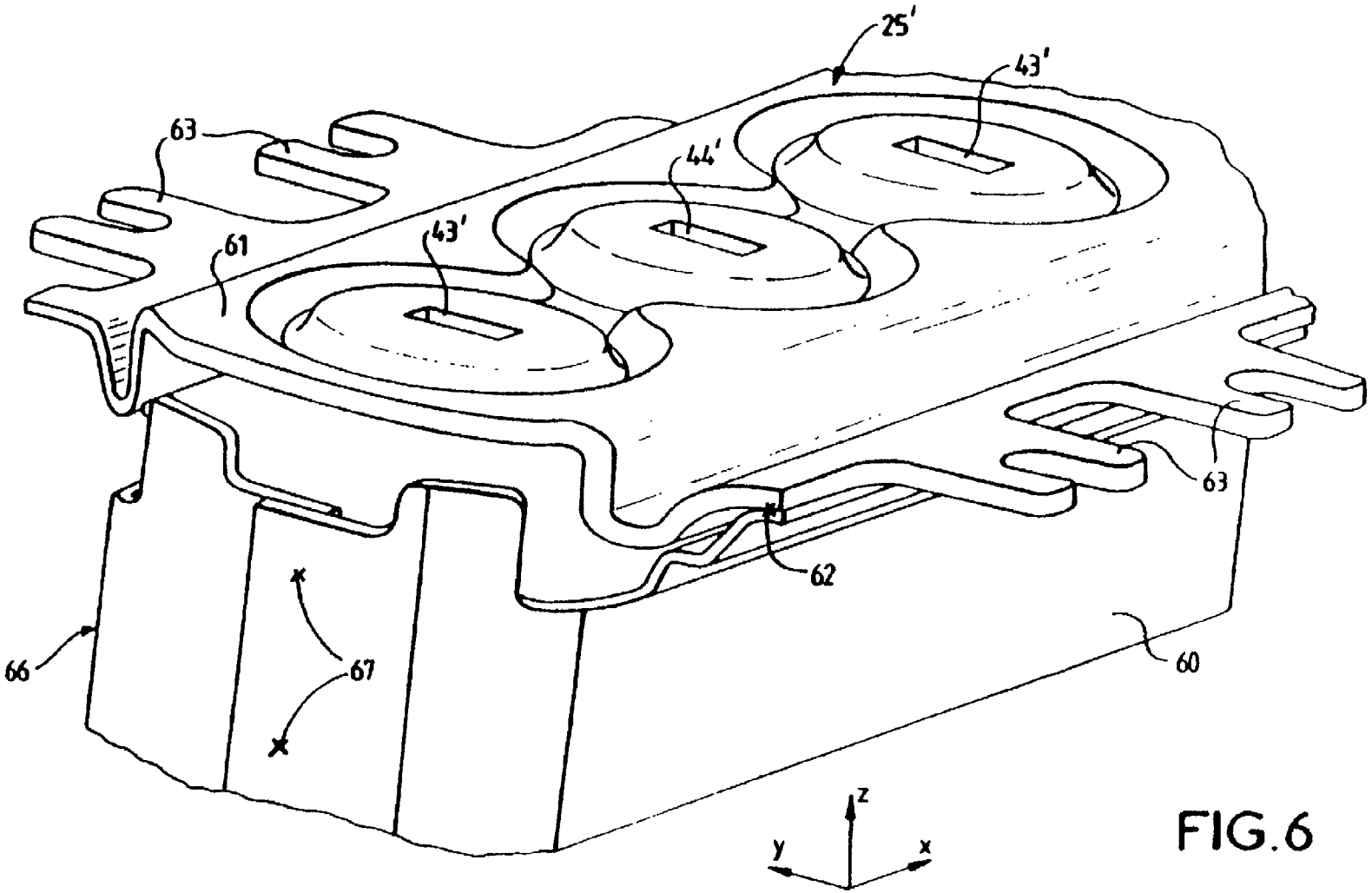
FIG. 6 shows in perspective an electrode G1 according to the invention.

FIG. 6 shows in perspective the electrode G1 made from three metal components: the substantially planar surface of electrode 61 drilled with apertures 44', 43' and the two components of the skirt 60, 66 which are welded together level with an end 67 overlapping; the geometry of the periphery 62 of 60, 66 is tailored in such a way as to come into stress-free contact with the substantially planar surface of 61. The cathode modules are subsequently inserted into this assembly and welded to the skirt 60, 66.

By having a skirt 60, 66 consisting of at least two components 60 and 66, it is possible to achieve tailored positioning of the periphery 62 of the skirt 60, 66 intended to come into contact with the surface of the component 61, to which surface it will be welded. Regarding the Z axis as the principal axis of the tube, the X axis parallel to the direction of alignment of the holes 43, 44 and the Y axis perpendicular to X, the positioning of 60 with respect to 66 is achieved by a parting of the two components along the Y direction and a positioning along the Z axis in such a way that the periphery 62 mates, without mechanical stress, with the surface of the component 61. The assembly is secured by welding the ends 67 which therefore overlap at least partially.

The principle may be extended in a simple manner to a skirt consisting of more than two separate components. In this way, it is possible to modify the geometry and the dimensions of the cathode and of its supports without having to modify the planar part 61, bearing the orifices 43', 44'. The planar part 61 has very tight tolerances, owing to the fact that its geometry determines the electron optics of the gun in the zone of formation of the beam or beams; this results in a saving when tailoring new cathode modules to an existing electrode G1 both in terms of design of the component and the tools for manufacturing said component.

In an advantageous embodiment, the two parts 60 and 66 are of strictly identical geometry and dimension. This makes it possible both to reduce the manufacturing costs and to obtain easier management of the stock of components, the electrode G1 then consisting of only two different types of components.

The invention can be adapted to the making of any type of electrode comprising a planar part of highly critical geometry and a cylindrical part which extends along the Z direction for a considerable length, that is to say over a length equal to at least five times the thickness of the planar part, a structure which makes deep-drawing unsuitable for application to electron gun electrodes.

What is claimed is:

1. An electron gun comprising:

at least one cathode for emitting an electron beam;

a dish-shaped control electrode comprising a substantially planar part provided with at least one aperture for the passage of the electron beam emanating from the cathode and a skirt at least partially surrounding the cathode; and means for supporting the cathode so as to keep the cathode at a specified distance from the control electrode, wherein the control electrode comprises at least three separate metal components the substantially planar part of the control electrode having a center portion drilled with the at least one aperture which are intended to face each cathode and two end portions, wherein the center portion is connected to each of the two end portions through a curved portion, at least two metal components forming the skirt at least partially surrounding the cathode, wherein the ends of the two components overlap at least partially, and wherein the outer surface of one end of the two components faces the inner surface of the end of the other of the two components, and wherein the two metal components each having peripheries extending outward from the cathode for attaching to the end portions of the substantially planar part.

2. The electron gun according to claim 1, wherein the cathode support means are secured to the skirt.

3. A cathode-ray tube comprising an electron gun in accordance with claim 1.

* * * * *